United States Patent [19]

Larson

[11] 4,269,322

[45] May 26, 1981

[54] FLEXIBLE BAIL ASSEMBLY

[75] Inventor: Curtis L. Larson, Hudson, Wis.

[73] Assignee: Minnesota Mining and Manufacturing Company, St. Paul, Minn.

[21] Appl. No.: 26,660

[22] Filed: Apr. 3, 1979

[51] Int. Cl.[3] ..... B65D 25/28; B65D 63/18

[52] U.S. Cl. ..... 220/94 R; 24/16 PB; 24/17 AP; 215/100 A; 229/DIG. 6; 428/77; 428/910; 294/170

[58] Field of Search ..... 294/31.2; 215/100 A; 220/DIG. 14, 94 R; 224/45 AA, 55; 229/52 BG, DIG. 6; 24/16 PB, 17 AP; 190/59, 58 A; 428/910, 40, 41, 77; 150/12

[56] References Cited

U.S. PATENT DOCUMENTS

| | | | |
|---|---|---|---|
| 3,031,359 | 4/1962 | Blank et al. | 428/77 A |
| 3,366,360 | 1/1968 | Burke | 215/100 A |
| 3,582,453 | 6/1971 | Sloan et al. | 24/16 PB X |
| 3,623,633 | 11/1971 | Kinn | 215/100 A X |
| 4,137,362 | 1/1979 | Miki et al. | 428/910 X |
| 4,152,475 | 5/1979 | Haley | 24/16 PB X |

FOREIGN PATENT DOCUMENTS

| | | | |
|---|---|---|---|
| 1327847 | 8/1973 | United Kingdom | 428/910 |

*Primary Examiner*—George F. Lesmes
*Assistant Examiner*—Alexander S. Thomas
*Attorney, Agent, or Firm*—Cruzan Alexander; Donald M. Sell; William L. Huebsch

[57] ABSTRACT

An elongate bail adapted for use on a container. The bail comprises a polyester web having a thickness in the range of 75 to 225 micrometers prestretched at a ratio in the range of about 2:1 to 4.5:1 to uniaxially orient the web longitudinally of the bail. Adhesive coatings on end portions of the bail are adapted to adhere the bail to the side surfaces of the container. The uniaxially oriented polyester web has sufficient residual stretching ability to cushion shock applied centrally of the bail from the adhesive which attaches the end portions of the bail to the container, and restricts notch sensitivity of the bail in a direction transverse to the bail.

4 Claims, 2 Drawing Figures

FLEXIBLE BAIL ASSEMBLY

BACKGROUND OF THE INVENTION

The present invention relates to bails made from tape for suspending containers from an overhead support.

Containers of fluid adapted to be fed intravenously into a patient have conventionally been provided by drug companies with bails attached adjacent their ends opposite the opening for the container so that the containers can be suspended with the container's opening down to allow fluid from the containers to be drained from the containers into patients through intravenous administration sets.

Typically the bails on such containers have consisted of an arcuate length of metal wire attached to the container at its ends by a metal band extending around the bottle and received in a groove around the bottle to restrict movement of the band axially of the bottle.

Such bails have been expensive to provide for several reasons, including the need to form bottles with a groove adapted to receive the band, and the need for hand labor to apply the bail and band assemblies to the containers.

Also, containers fitted with metal bails and bands must be hand inserted into cases in which they are shipped due to a tendency for the bails to catch on the cases; and the metal bails can rust, have a tendency to damage labels on the bottles to which they are attached, and have a tendency to engage bails on adjacent bottles stored on a shelf so that two bottles may be pulled from a storage shelf when only one was intended.

Thus the use of bails made of tape has been proposed in the past; however, heretofore such bails have not been commercially acceptable because they have not both provided the appropriate physical properties to ensure that the bails will not break or separate from the container at their adhesive bond under handling conditions which the suspended bottle may encounter (such as when a suspended bottle is dropped and then stopped via the bail as when a portable cart on which it is suspended drops over a ledge) while still being sufficiently thin and flexible to afford ease of packing the container to which they are attached.

SUMMARY OF THE INVENTION

According to the present invention there is provided a tape bail which is very thin and flexible to afford ease of storing and packaging a container on which it is attached while being at least as strong and serviceable as metal bails and bands commonly in use.

The bail according to the present invention comprises a polyester web having a thickness in the range of 75 to 225 micrometers (3 to 9 mils) which has been prestretched at a ratio in the range of about 2:1 to 4.5:1 to uniaxially orient the web longitudinally of the bail; and adhesive coatings on portions of the bail adjacent its ends, which adhesive coatings are adapted to adhere the end portions of the bail to opposite side surfaces of a container with a central portion of the bail extending around an end of the container.

Bails made of polyester webs in the thickness range of 75 to 225 micrometers (3 to 9 mils) have been found to provide a desired degree of flexibility which allows the bail to deflect out of the way when the bottles to which they are attached are inserted in cases or placed on shelves for storage with the end of the container which the bail transverses lowermost. Such bails, however, when biaxially oriented have such a high sensitivity to a notch along one edge that they will tear transversely under shock loads applied to the bail which can easily be encountered in use. Such notch sensitivity can be substantially reduced by longitudinally stretching the bail to uniaxially orient the bail, which also desirably produces a higher tensile strength in the bail. When the bail is stretched to produce the maximum tensile strength, however, it has been found that sudden forces transmitted through the bail can fracture the bond between the end portions of the bail and the bottle. Polyester webs uniaxially stretched in the range indicated, however, provide a bail with both the desired notch tear resistance and an amount of potential elongation to distribute shock applied centrally of the bail so that it will not be instantaneously transmitted to the adhesive bonds to cause those bonds to release from the container.

Preferably the bails have a length such that when they are supported at their mid point over a thin support rod (i.e. less than ½ inch diameter), the portions of the bail between the support rod and the bottle will be disposed at an angle of about 90 degrees with respect to each other.

The adhesive for adhering the end portions of the web to the bottle preferably is a high-shear synthetic rubber resin pressure-sensitive adhesive, although high-shear heat-activatable adhesives could also be used.

In a preferred embodiment the polyester web has a pressure-sensitive adhesive coating entirely covering one surface, and further includes a thin layer (e.g., about 50 micrometers or 2 mils thick) of soft, unoriented polymeric cover film adhered by the adhesive coating over a central portion of the polyester web between its end portions attached to the bottle. This cover film primarily serves to cover the adhesive coating along the central portion of the polyester web, but also provides added longitudinal strength and transverse tear resistance to the bail, and adds thickness to the center portion of the bail to restrict edge cuts from the bail. This cover film should be of a material (e.g., polyethylene) having sufficiently low internal strength that adhesion between the adhesive and the cover film will elongate the cover film with the polyester web to prevent separation therebetween.

Also, preferably lengths of pressure-sensitive adhesive-coated tape are adhered around the bottle over the end portions of the polyester web adhered to the bottle. While these lengths of tape do not provide a substantially larger holding force between the bail and bottle than is already provided by the adhesive therebetween, they do restrict contact of other objects with the adhesively secured end portions of the bail which might otherwise peel those end portions away from the container; and they give the appearance of adding substantially to the structural strength of the bail assembly, which helps user acceptance thereof.

Preferably both the web and the backing layer of the tape used to encircle the container over the end portions of the bail have a metal vapor coating on their surface adjacent their adhesive coating. This coating gives both the bail and the tape around the bottle a dull metal-like appearance when viewed through the transparent web and backing of the tape and is protected from being scratched off by the web and backing for the tape so that it will not become unsightly due to handling and packaging of the bottle.

Also preferably the bail and the tape encircling the bottle over the end portions of the bail are applied to the containers via a machine such as that described in U.S. Patent Application Ser. No. 000,926 filed Jan. 4, 1979, the disclosure whereof is incorporated herein by reference.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
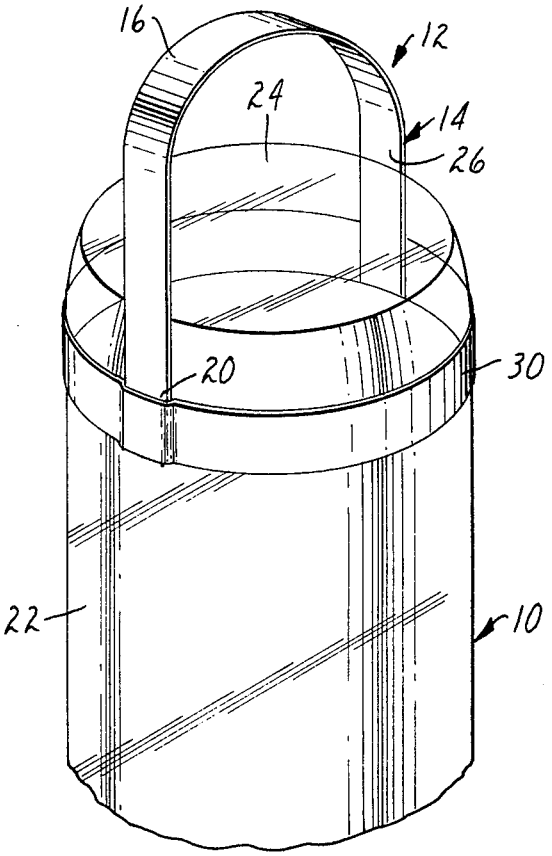
FIG. 1 is a fragmentary perspective view of a bottle having attached thereto a flexible bail assembly according to the present invention.

Referring now to the drawing, there is shown a bottle 10 having attached thereto a bail assembly 12 including a bail according to the present invention generally designated by the reference numeral 14.

Figure 2:
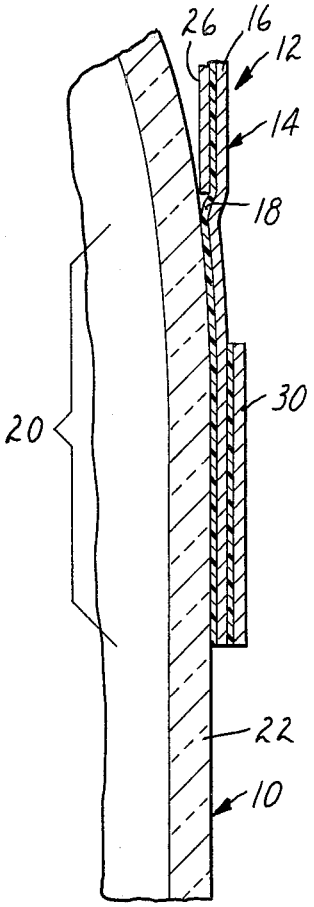
FIG. 2 is an enlarged sectional view of the bottle and bail assembly shown in FIG. 1.

The bail 14 comprises an elongate polyester web 16 in the range of 75 to 225 micrometers (3 to 9 mils) thick which has been prestretched in its longitudinal direction at a ratio in the range of about 2:1 to 4.5:1 to uniaxially orient the web 16 along its length. The web 16 has an adhesive coating 18 (FIG. 2) on one surface which adheres end portions 20 of the web 16 to opposite side surfaces 22 of the bottle 10, with the central portion of the bail 14 extending around an end 24 of the bottle 10.

Also included in the bail 14 is a thin, soft, unoriented polymeric cover film 26 adhered by the adhesive coating 18 over a central portion of the web 16 primarily to cover the adhesive coating 18; but which cover film 26 also adds longitudinal strength and transverse tear resistance to the bail 14, and provides thickness to the bail 14 to prevent edge cuts during handling thereof. The bail assembly 12 also includes lengths of pressure-sensitive adhesive-coated tape 30 adhered around the bottle 10 over the end portions 20 of the web 16 which both restrict peeling of the end portion 20 from the bottle via contact with other objects and provide a more secure appearance for the attached bail 14.

EXAMPLE

To a plurality of 1000 ml. generally cylindrical glass liquid filled bottles, each weighing about 1.55 kg. (3.4 lbs.) and having outside diameters of about 10 centimeters (4 inches), were adhered bails 14 having lengths of 21.6 centimeters (8-½ inches) and widths of 0.95 centimeters (⅜ inch), which bails 14 were of various thickness and of polyester material comprising polyethylene terephthalate (PET) alone or in combination with polymethylene terephthalate (PTMT), and which polyester materials had been prestretched at various ratios to uniaxially orient the material longitudinally of the bails 14. A chain was attached at one end to a fixed overhead support and at its other end to the centers of the bails 14 and the bottles 10 were dropped at varying predetermined heights, after which the movement of the bottles 10 was stopped via the chain and bail 14. The various bails 14 were tested both without any nicks along their edges and with nicks along their edges produced by making a 0.16 centimeter (1/16-inch) deep transverse cuts into the bails 14 with a razor blade. Some nicks were made at the center of the bails 14 (designated "A" nicks herein), and some nicks were made about halfway between the centers of the bails 14 and the side of the bottles 10 (designated "B" nicks herein).

In addition to the drop tests described above, the break strength of the various bails 14 and their percent elongation prior to break were measured by pulling the bails 14 to failure on an "Instron" testing machine. The results of these tests are set forth in the following table.

TABLE

| Web 16 Material | Web 16 Prestretch Ratio | Web 16 Thickness (micrometers) | Bail 14 Tensile Strength (kg./cm. width) | Bail 14 Percentage Elongation At Failure | Bottle Drop Height Without Failure (in cm.) | | |
|---|---|---|---|---|---|---|---|
| | | | | | No Nick | "A" Nick | "B" Nick |
| 100% PET | 3.0:1 | 101.6 | 23.1 | 124 | 50+ | 12.7 | 5.1 |
| 100% PET | 3.0:1 | 127 | 20.4 | 46 | 50+ | 15.2 | 15.2 |
| 100% PET | 3.5:1 | 127 | 22.7 | 54 | 50+ | 15.2 | 12.7 |
| 60% PET/40% PTMT | 3.0:1 | 127 | 16.3 | 167 | 50+ | 5.1 | 7.6 |
| 40% PET/60% PTMT | 3.0:1 | 127 | 17.2 | 170 | 50+ | 7.6 | 15.2 |

When 116.3 micrometer (4.5 mil) thick webs 16 of 100% PET biaxially (instead of uniaxially) prestretched at a prestretch ratio of 3.5:1 in both directions were used in the test reported above, drop heights for bails 16 without nicks also exceeded 50 cm. (20 inches). However, such bails 16 with "A" nicks failed at drop heights of less than 2.54 cm. and such bails 16 with "B" nicks failed at drop heights of about 2.54 cm. or 1 inch, which is unacceptable.

I claim:

1. In combination:

a container having an end and opposite outer side surfaces adjacent said end;

an elongate bail having opposite ends and comprising a polyester web having a thickess in the range of 75 to 225 micrometers (3 to 9 mils), and being prestretched longitudinally at a ratio in the range of about 2:1 to 4.5:1 to uniaxially orient the web longitudinally of the bail;

adhesive coating on portions of said bail adjacent said ends adhering said end portions of said bail to the opposite side surfaces of said containers with a central portion of said bail extending transverse to the end of said container;

said uniaxially-oriented web having sufficient residual stretching ability to cushion shock applied centrally of the bail from the adhesive for attaching the end portions of the bail to a said container and restricting notch sensitivity of said web in a direction transverse to said bail; and lengths of pressure-sensitive adhesive-coated tape adhered to said container and over the end portions of said bail to restrict contact of other objects with the adhesively-secured end portions of the bail and give the appearance of adding substantially to the structural strength of the combination.

2. A combination according to claim 1 wherein said polyester web has a pressure-sensitive adhesive entirely covering one surface, and further includes a layer of ductile, generally unoriented polymeric film adhered by said coating over the central portion of said bail between said end portions and having sufficiently low internal strength so that adhesion between said adhesive and said cover film will elongate said cover film with said web.

3. A combination according to claim 1 wherein said lengths of pressure-sensitive adhesive-coated tape encircle said container.

4. A combination according to claim 1 wherein said bail has a length such that when it is supported at its mid point between said end portions, the portions of said bail between said mid point and said end portions will be disposed at about a 90 degree angle with respect to each other.

* * * * *